US006915920B2

(12) United States Patent
Hwang et al.

(10) Patent No.: US 6,915,920 B2
(45) Date of Patent: Jul. 12, 2005

(54) BOTTLE STOPPER

(75) Inventors: Hsu-Rong Hwang, Taipei Hsien (TW); Sen-Yih Lin, Tainan Hsien (TW)

(73) Assignee: Sunlot Bottle Stopper Co., Ltd., Kaohsiung (TW)

( * ) Notice: Subject to any disclaimer, the term of this patent is extended or adjusted under 35 U.S.C. 154(b) by 104 days.

(21) Appl. No.: 10/473,149

(22) PCT Filed: Apr. 11, 2001

(86) PCT No.: PCT/US01/08649

§ 371 (c)(1),
(2), (4) Date: Oct. 9, 2003

(87) PCT Pub. No.: WO02/083515

PCT Pub. Date: Oct. 24, 2002

(65) Prior Publication Data

US 2004/0112856 A1 Jun. 17, 2004

(51) Int. Cl.[7] ..... B65D 39/12
(52) U.S. Cl. ..... 215/358; 215/364; 220/234
(58) Field of Search ..... 215/358, 359–362, 215/234, 295–299, 364; 220/234–238

(56) References Cited

U.S. PATENT DOCUMENTS 2,021,259 A 11/1935 Magnuson
2,190,072 A 2/1940 Guala
2,572,719 A 10/1951 Roddier
2,718,794 A 9/1955 Helbig
3,638,821 A 2/1972 Guala
3,926,329 A 12/1975 Guala
5,109,997 A * 5/1992 Phillips ..... 215/360
6,168,036 B1 * 1/2001 Teng ..... 215/296
6,536,618 B1 * 3/2003 Hwang et al. ..... 215/358
6,719,160 B2 * 4/2004 Sen-Yih ..... 215/361

* cited by examiner

*Primary Examiner*—Lien M. Ngo
(74) *Attorney, Agent, or Firm*—Bacon & Thomas

(57) ABSTRACT

A bottle stopper mainly includes a body, a plug and a jacket. The body has an expansion spread by the plug and outwardly confronting with the jacket. The plug comprises two necks for two different engagements alternatively engaged with the body to provide a locking means and a resealing means for bottle neck. The body is structurally retained between the plug and the jacket being assembled as a unit to form the bottle stopper. When the bottle stopper is initially inserted into a bottle neck and pressed to position at the first engagement, the locking means provides a maximum expansion to lock around the bottle neck. And it has an appearance and a function of indicating whether the bottle neck has previously opened or the stopper has been used. When the bottle stopper is pressed downward positioning at the second engagement, the resealing means provides a slightly expansion for allowing to initially release and reseal the bottle neck.

24 Claims, 18 Drawing Sheets

BOTTLE STOPPER

BACKGROUND OF THE INVENTION

1. Field of the Invention

The present invention is related to a bottle stopper for conveniently inserting into bottle neck, completely sealing it and preventing from unlawful reuse in closing process, and more particularly to the bottle stopper for using to reseal bottle neck opened.

2. Description of the Related Art

Liquor, wine or the like is conventionally contained in glass or ceramic bottle. Before the bottling process, distilled heat liquor has already situated in high inner pressure. In the bottling process, when the traditional plug is typically forced into the neck of a filled bottle, the inner pressure in the filled bottle is essentially greater than atmospheric pressure. Typically, the diameter of plug is apt to slightly greater than the inner circumference of the bottle neck in order to sealably confront each other when the plug is axially inserted into the bottle neck. The plug, therefore, is capable of withstanding substantial inner pressure over long storage periods without deterioration or effect on the contents. During the bottling process, it is hard while the plug is inserted as intended into the bottle neck. In particular, the plug is hard to be remained in the bottle neck by an axially directed inner pressure from within the bottle.

The conventional plug is made of cork which has capillary. The inner pressure from within the bottle, thus, will be released through the capillary of the cork during closing bottle process so that the plug has an improved seal in the bottle neck. However, the plug necessitates to tightly seal the bottle neck and thus it is hard to be inserted into the bottle neck in the bottling process. In addition, wet and aged cork tends to disintegrate and it is often difficult to remove from the bottle neck. Accordingly, it is inconvenient to remove the cork when it is easily snapped in two.

There is a serious problem in the market. Illegal factories fabricate fake liquor or wine by using the used bottles and plugs on which covering a new and intact cap of tinfoil or a plastic material. Accordingly, there is a need of performing the function of indicating whether or not the bottle has previously been opened. Therefore, preventing from reusing plug is one of solutions.

Applicant's PCT application serial No. PCT/US00/28866 discloses a bottle plug mainly including a bottle plug member and an elastomer member. The bottle plug member consists of a gas-tight means and a reuse-proof means and further inserts into the elastomer member being assembled as a unit to form the bottle plug. When the bottle plug is inserted into a bottle neck, the gas-tight means provides an expansion portion to seal the bottle neck and the reuse-proof means provides an appearance and the function of indicating whether the bottle neck has previously opened or the bottle plug has been used. The used bottle plug cannot employ again to reseal a bottle neck even though it can prevent from unlawful reuse in bottle closing process. However, such bottle plug's elements cannot be made of glass, crystal, ceramic or manufactured various designs of bottle head.

The present invention intends to provide a bottle stopper including a locking means and a resealing means in such way to as to mitigate and overcome the above problems.

SUMMARY OF THE INVENTION

The primary objective of this invention is to provide a bottle stopper with two expansion portions for forming a locking means and a resealing means in bottle neck, which is particularly capable of reusing the used bottle stopper after initially released.

The secondary objective of this invention is to provide a bottle stopper with an obstructer which can prevent from an accidental press of a plug.

The further objective of this invention is to provide a bottle stopper with a head portion which can be made of various kinds of material and designed various preferred shape.

The present invention is the bottle stopper which mainly includes a body, a plug and a jacket. The body has an expansion spread by the plug and outwardly confronting with the jacket. The plug comprises two necks for two different engagements alternatively engaged with the body to provide a locking means and a resealing means for bottle neck. The body is structurally retained between the plug and the jacket being assembled as a unit to form the bottle stopper. When the bottle stopper is initially inserted into a bottle neck and pressed to position at the first engagement, the locking means provides a maximum expansion to lock around the bottle neck. And it has an appearance and a function of indicating whether the bottle neck has previously opened or the stopper has been used. When the bottle stopper is pressed downward positioning at the second engagement, the resealing means provides a slightly expansion for allowing to initially release and reseal the bottle neck.

Other objectives, advantages and novel features of the invention will become more apparent from the following detailed description and the accompanying drawings.

BRIEF DESCRIPTION OF THE DRAWINGS

The present invention will now be described in detail with reference to the accompanying drawings herein.

DETAILED DESCRIPTION OF THE INVENTION

Figure 1:
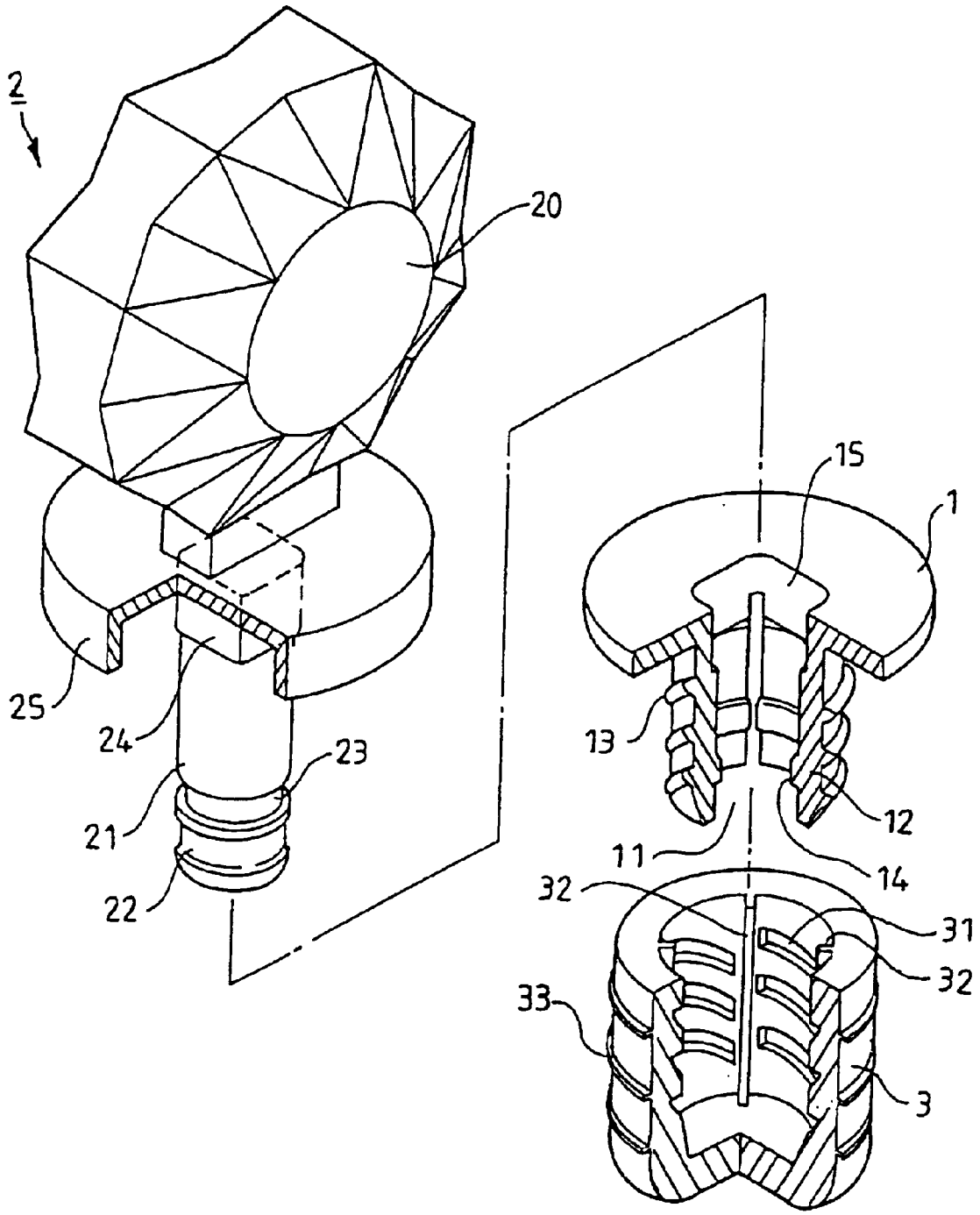
FIG. 1 is an exploded perspective view-in partial cut-away illustrating a bottle stopper in accordance with a first embodiment of the present invention.
Figure 2:
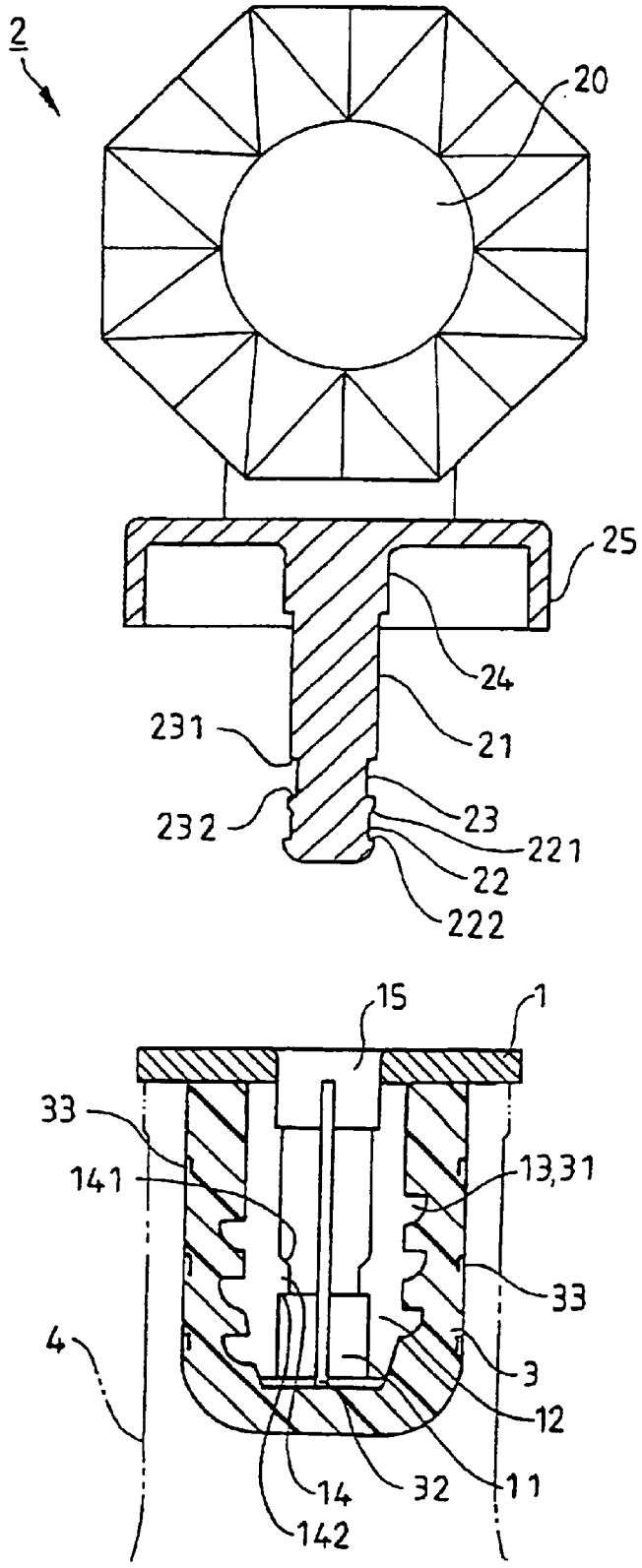
FIG. 2 is a vertical sectional view illustrating the bottle stopper in accordance with the first embodiment of the present invention in the first step of closing bottle process.

Referring to FIG. 1, a bottle stopper in accordance with a first embodiment of the present invention mainly includes a body generally designated as numeral 1, a plug as numeral 2 and a jacket as numeral 3. Referring to FIGS. 1 and 2, the body 1 is made of plastic material and includes an opening 15 formed on its top and a plurality of flexible walls 12 projected downward from the top and encircled an axis to define a space with an opening 11. The inner circumference of each flexible wall 12 provides a slightly protrusion 14 projecting inwardly in a common plane perpendicular to the axis defined by the body 1. The outer circumference of each flexible wall 12 further provides a plurality of screwing ribs 13 projecting outwardly and encircling co-axially around the axis of the body 1. The plug 2 is essentially consisted of a head 20 and a leg 21 combined by adhesive. The head is made of crystal, glass, ceramic or the like. The preferred shape of the head 20 is dictated somewhat by tradition and etiquette. The rod-shaped or cannular leg 21 is confined within contours of the inner circumference of the body 1. The leg 21 provides a first neck 22 to form a locking means and a second neck 23 with a smaller diameter relative to the first neck 22 to form a resealing means. The two necks 22 and 23 are co-axially juxtaposed in serious along the axis of the leg 21 so that the plug can be pressed downward to change the locking status to resealing status. The two necks 22 and 23 are adapted to be engaged with the protrusion 14 of the body 1 to provide two diametrically different protrusions of the bottle stopper when the leg 21 is inserted into the space formed by the flexible wall 12. The leg 21 cannot be released from the body 1 for taking apart, when the protrusion 14 is engaged with either the neck 22 or 23. The neck 22 has a slightly inclined surface 221 projected in a common conical surface defined by the axis of the leg 21 and a perpendicular surface 222 relatively perpendicular to the axis of the leg 21. By contrast, the neck 23 just has two perpendicular surfaces 231 and 232 sectioning the leg 21. The protrusion 14 has an inclined surface 141 conforming with the inclined surface 221 of the neck 22 for easily sliding so that the neck 22 of the plug 21 can be conveniently pressed to engage with the protrusion 14 of the body 1. In order to prevent the leg 21 relatively rotating to the body 1, the initial end of the cross section of the leg 21 forms a square confined within the opening 15 of the body. In addition, the plug 2 has an annular wall 25 formed from a common plane and projecting along the axis of the leg 21. The jacket 3 may be made of cork, foamed plastic material, compressible material or the like which cannot chemically contaminate the content within the bottle giving it a distressing taste and permits only a miniscule amount of air to enter the bottle as well as breathing. The jacket 3 is cup-shaped part with a cavity in which adapted to receive the combination of the body 1 and the plug 2 co-axially aligned to it. The inner circumference of the jacket 3 includes a plurality of grooves 31 encircling co-axially around its axis correspondingly engaging with the ribs 13 of the body 1 and a plurality of elongate ribs 32 parallel to its axis for precluding relative movement between the body 1 and the jacket 3. It is convenient to insert that the outer diameter of the jacket 3 is slightly less than the inside bottle neck diameter. The outer circumference of the jacket 3 with two different diameters corresponding to the expansion portion of the body 1 is adapted to securely confront the inner circumference of the bottle neck for locking and resealing. It is desirable that the body 1 and the jacket 3 can be formed as a singular member in molding process. In order to improve the sealing effect of the bottle stopper, a plurality of regularly spaced annular ribs 33 raises with respect to a cylindrical outer surface of the jacket 3 for intimately confronting with the inner circumference of the bottle neck.

FIG. 2 illustrates the bottle stopper in accordance with the first embodiment of the present invention in the first step of closing bottle process. Referring again to FIG. 2, the body 1 and the jacket 3 are assembled without the plug 2 and easily inserted into the bottle neck 4 because of without any expansion of the bottle stopper. The jacket 3, then, appears an outer diameter slightly less than the bottle neck diameter or is sized to snugly fit through the bottle neck.

Figure 3:
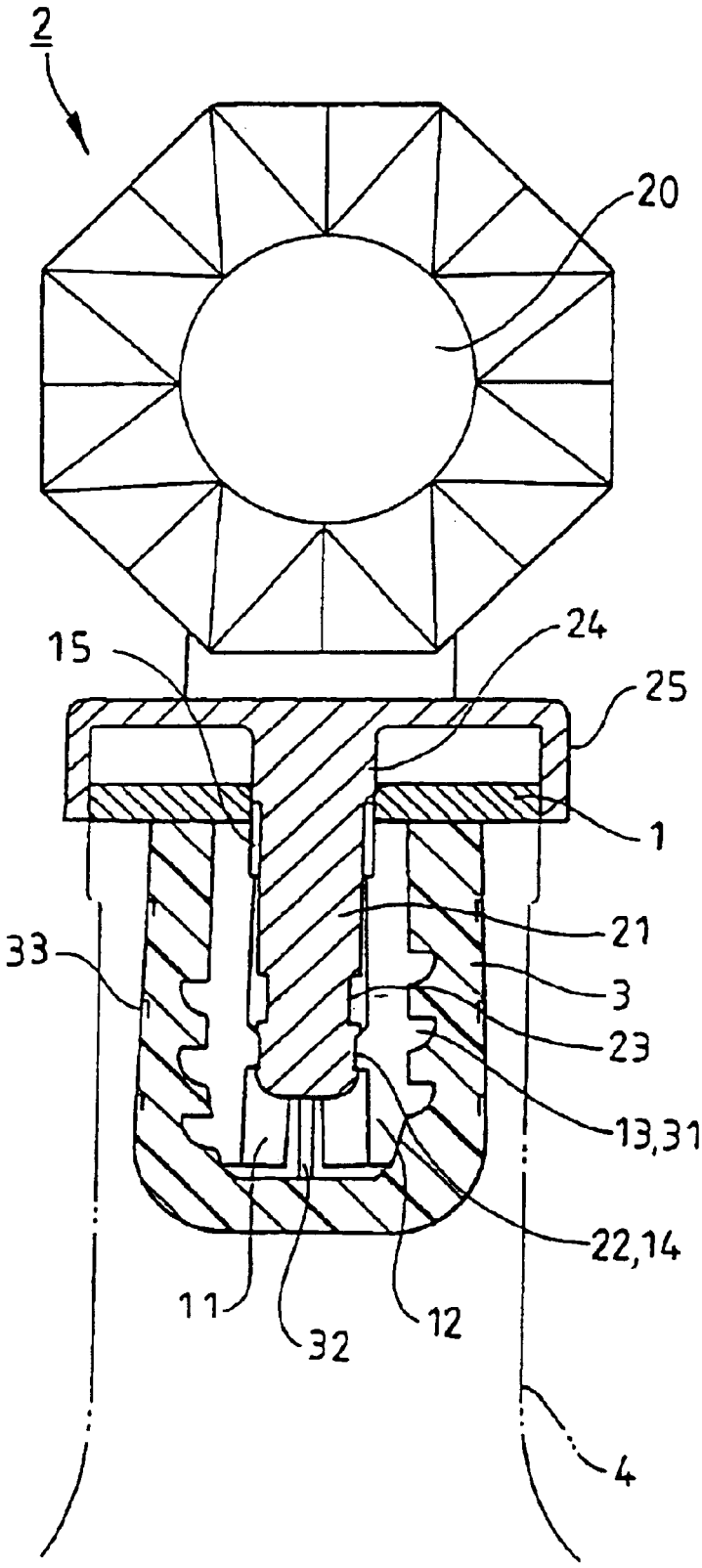
FIG. 3 is a vertical sectional view illustrating the bottle stopper in accordance with the first embodiment of the present invention in the first step of closing bottle process.

FIG. 3 illustrates the bottle stopper in accordance with the first embodiment of the present invention in the second step of closing bottle process. Referring to FIG. 3, the leg 21 is inserted into the opening 15 of the body 1 and pressed to engage the first neck 22 with the protrusion 14 to form a locking means after the body 1 and the jacket 3 are inserted prior into the bottle neck 4. Once the first neck 22 engages with the protrusion 14, the flexible walls 12 are radically expanded with respect to the axis of the body 1 such that the jacket 3 is securely confronted with the inner circumference of the bottle neck. Accordingly, when the first neck 22 engaged with the protrusion 14, the leg 21 can only allow pressing to advance in the body 1 via the surface 221 (labeled in FIG. 2) sliding on the surface 141 (labeled in FIG. 2). The locking means provides a maximum expansion to lock around the bottle neck 4, which cannot be released from the bottle neck 4. And then the top of the body 1 is coplanar with the end of the annular wall 25 so that it has an appearance and a function of indicating whether the bottle neck has previously opened or the stopper has been used.

Figure 4:
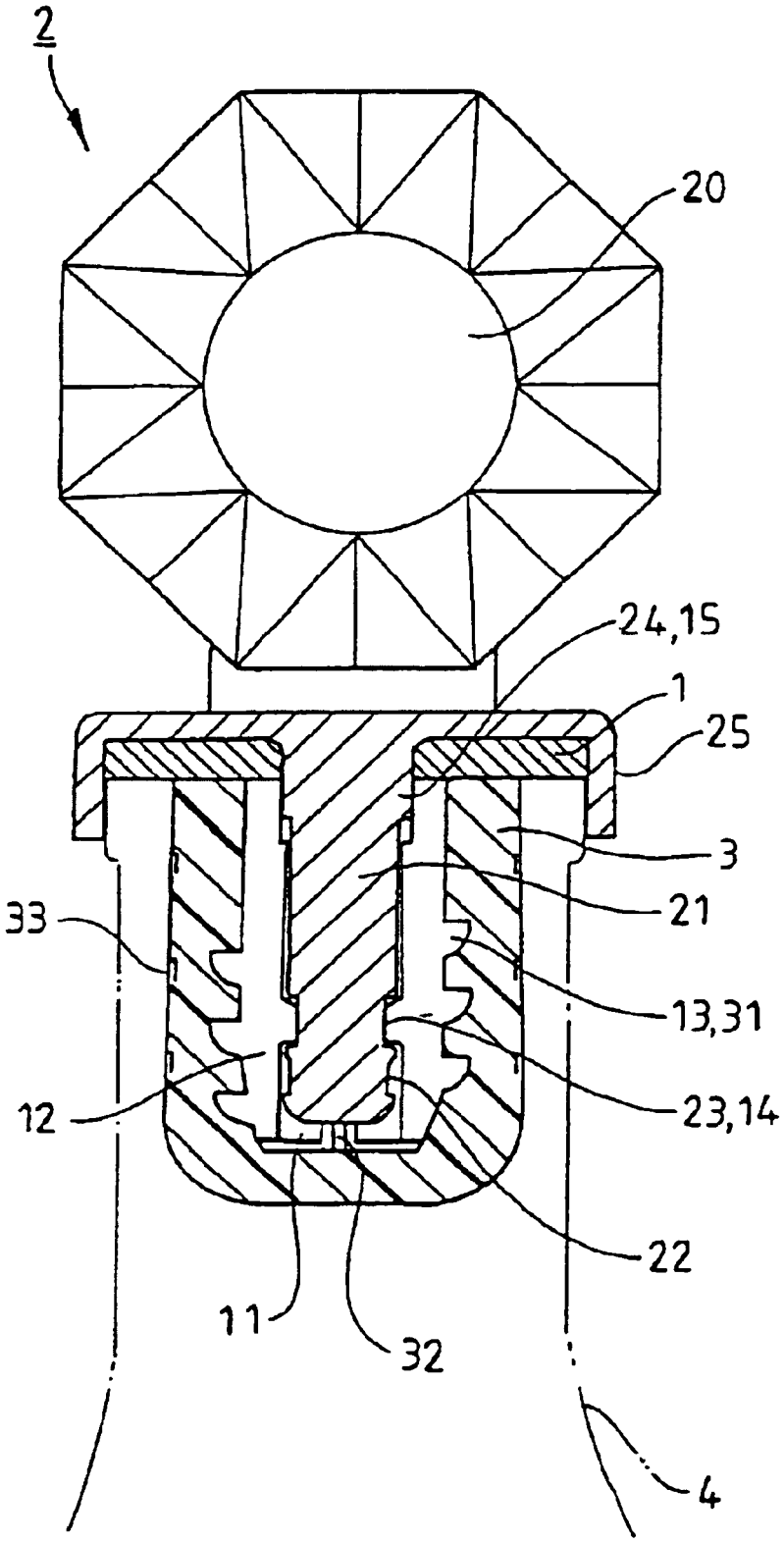
FIG. 4 is a vertical sectional view illustrating the bottle stopper in accordance with the first embodiment of the present invention in a step for releasing and resealing bottle neck.

FIG. 4 illustrates the bottle stopper in accordance with the first embodiment of the present invention in a step for releasing and resealing bottle neck. Referring to FIG. 4, after the plug 2 is pressed downward to form a resealing means, the second neck 23 is then engaged with the protrusion 14 via the surface 221 sliding on the surface 141. The releasing means provides a slight expansion which diameter is relatively smaller than the diameter of the locking means for allowing to initially release the bottle neck 4. Accordingly, the bottle stopper can be initially released by upward pulling force and used to reseal the bottle neck 4. The second neck 23 is firmly engaged with the protrusion 14 and cannot release from it, when the top of the body 1 will arrive at the bottom of the annular wall 25 and be received within it. It, therefore, indicates with an appearance that the stopper has been used and the bottle neck 4 has previously opened.

Figure 5:
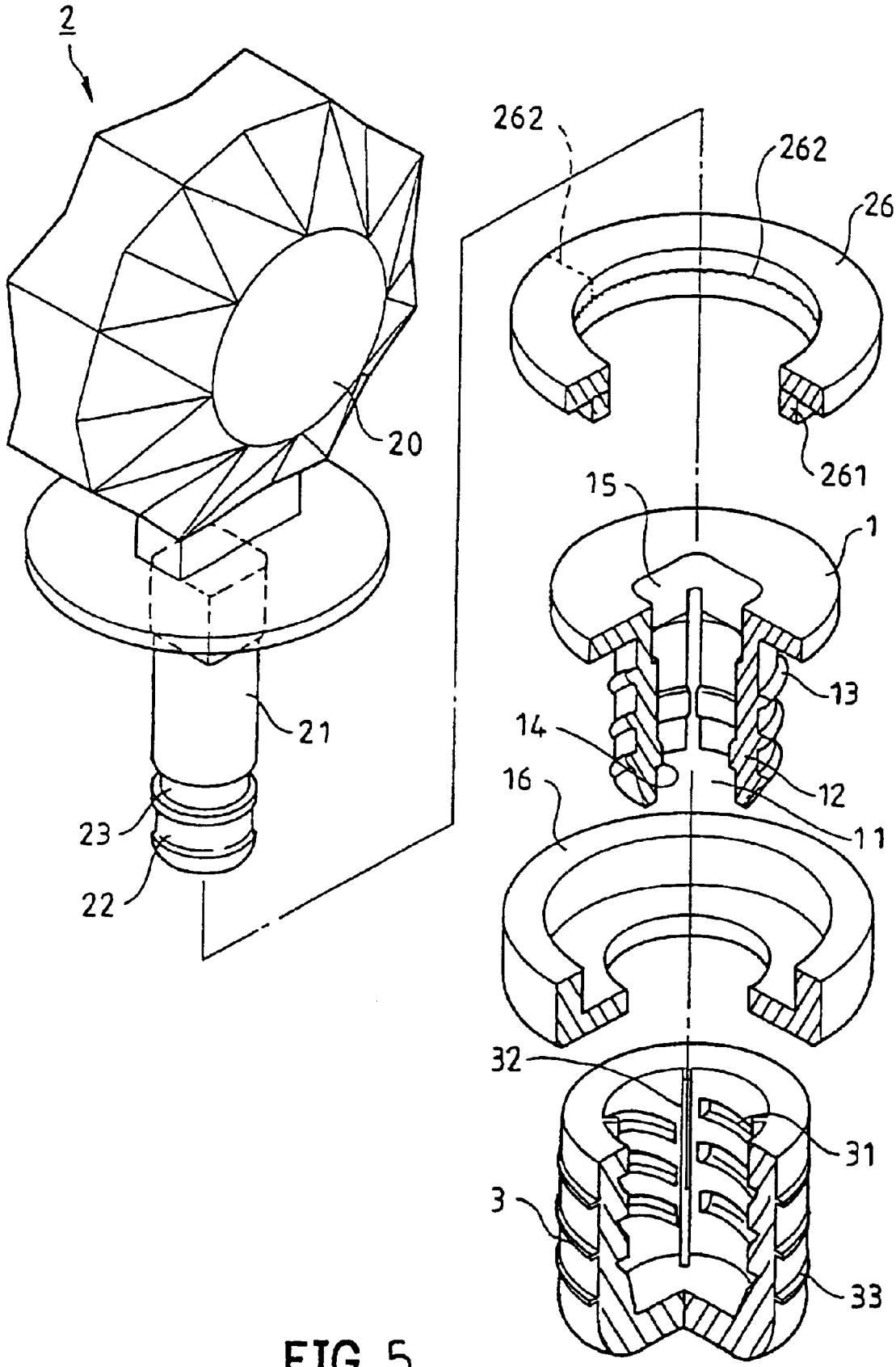
FIG. 5 is an exploded perspective view in partial cut-away illustrating a bottle stopper in accordance with a second embodiment of the present invention.

FIG. 5 illustrates the bottle stopper of the second embodiment of the present invention mainly comprising a body 1, an ornamental ring 16, a plug 2 and a jacket 3.

Referring to FIG. 5, reference numerals of the second embodiment has applied the identical numerals of the previous embodiment. The body 1, the plug 2 and the jacket 3 of the second embodiment have the similar configuration and same functions as the previous embodiment and the detailed descriptions are omitted. The ornamental ring 16 with an appropriate recess provides a circular edge receiving the top of the body 1 and a central opening for allowing the walls 12 of the body 1 extending through to combine with the jacket 3. The ornamental ring 16 is made of crystal, glass, metal or ceramic with the same as that of the plug 2 or bottle. The bottle stopper further comprises a gasket 26 having a base 261 and two tear line 262. The gasket 26 is received in the recess of the ornamental ring 16 to obstruct further advance of the leg 21 with respect to the body 1 and it assures engaging the first neck 22 with the protrusion 14.

Figure 6:
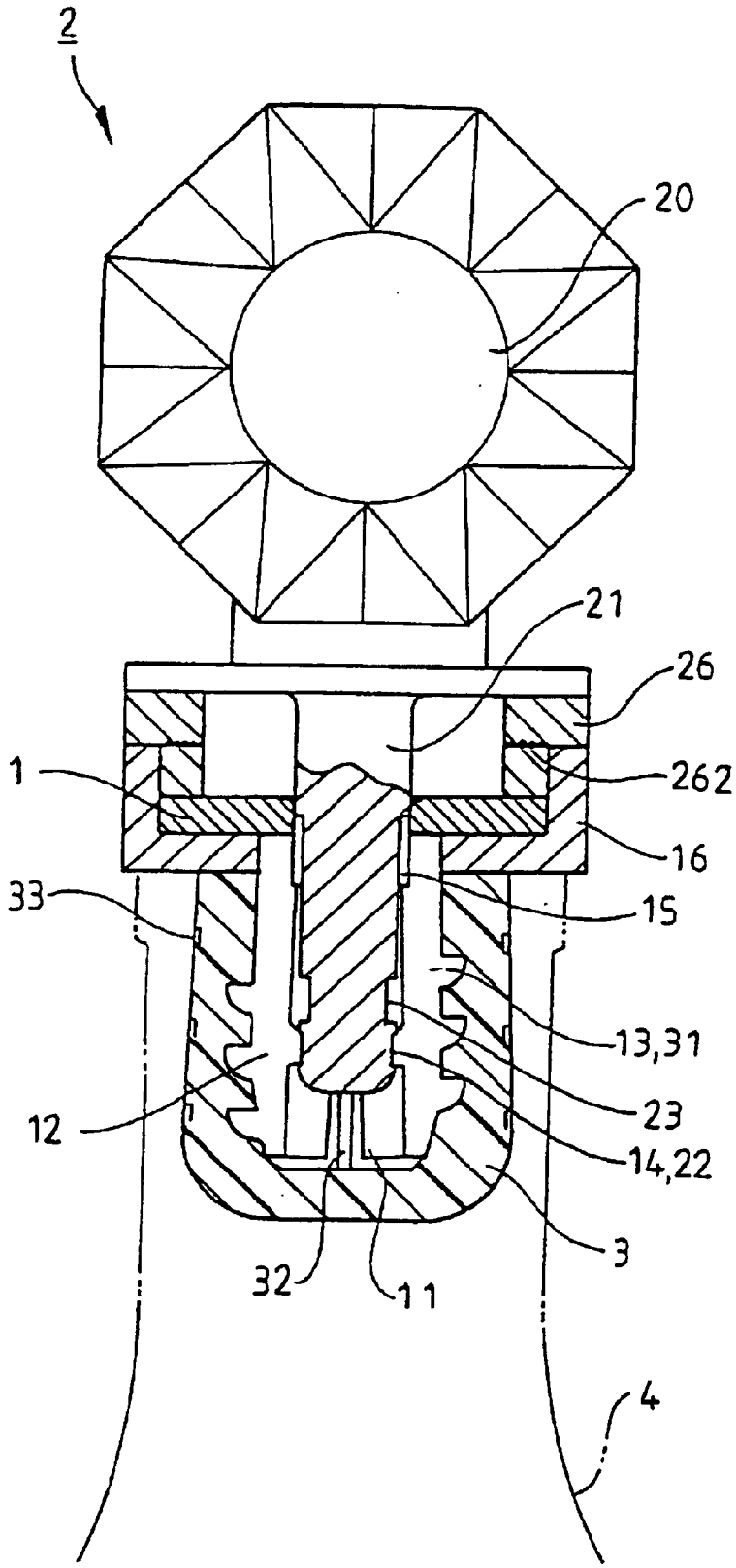
FIG. 6 is a vertical partially sectional view illustrating the bottle stopper in accordance with the second embodiment of the present invention in closing bottle process.

FIG. 6 illustrates the bottle stopper in accordance with the second embodiment of the present invention in closing bottle process. The technique of inserting the plug 2 to form a locking means has been described in detail in previous embodiment for reference. Referring again to FIG. 6, the radial edge of the top of the body 1 is held between the ornamental ring 16 and the gasket 26 when the first neck 22 engages with the protrusion 14. Accordingly, the gasket 26 obstructs the leg 21 of the plug 2 to advance downward relative to the body 1 that prevents the head 20 from being pressed to open the bottle neck 4 by accident. And it also has an appearance and a function of indicating whether the bottle neck has previously opened or the stopper has been used.

Figure 7:
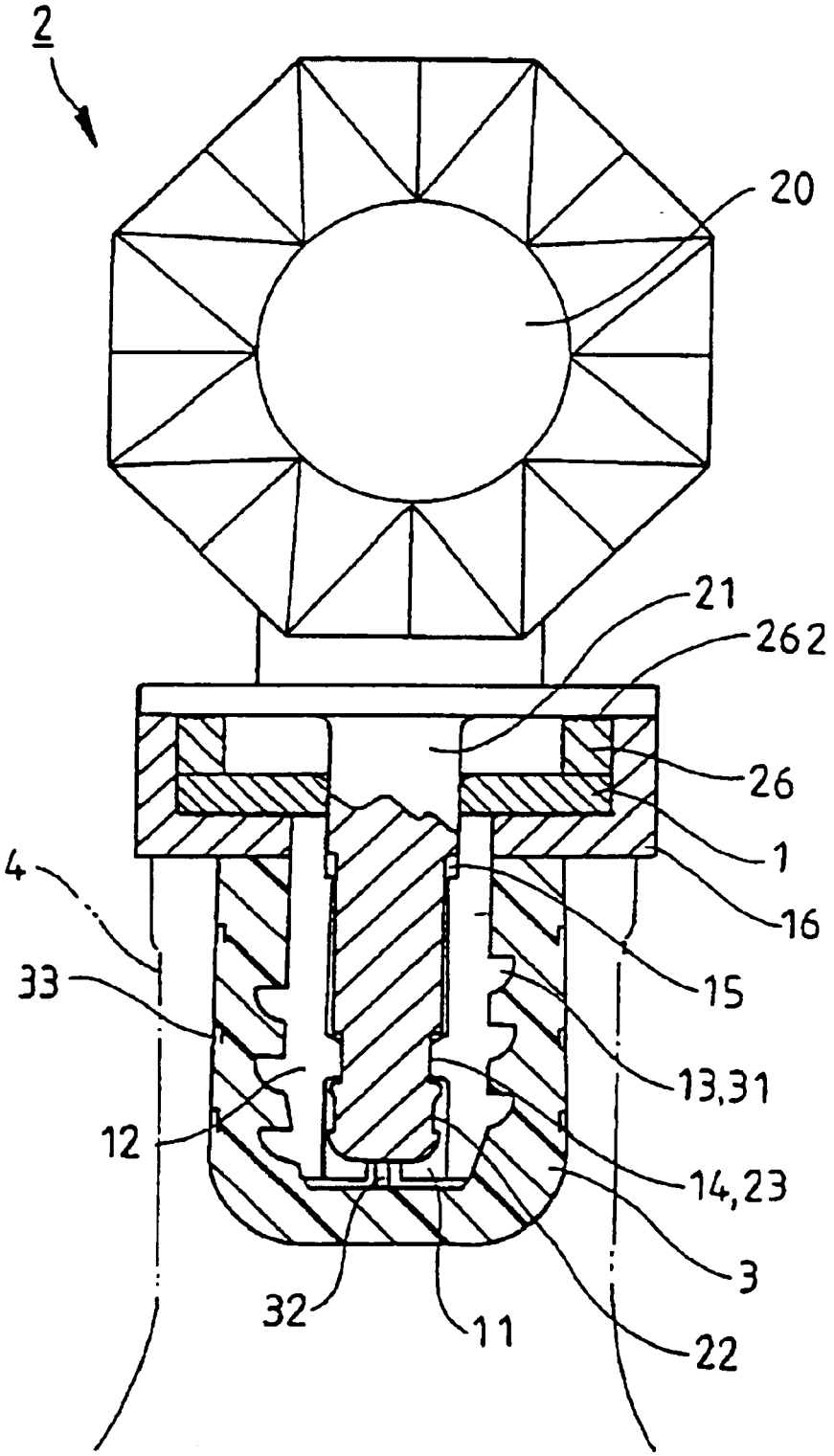
FIG. 7 is a vertical partially sectional view illustrating the bottle stopper in accordance with the second embodiment of the present invention in a step for releasing and resealing bottle neck.

FIG. 7 illustrates the bottle stopper in accordance with the second embodiment of the present invention in a step for releasing and resealing bottle neck. Referring again to FIG. 7, the major part of the gasket 26 has been tom off along the tear line 262 and the plug 2 is pressed downward to form a resealing means, when the second neck 23 is engaged with the protrusion 14. The releasing means provides a slight expansion which diameter is relatively smaller than the diameter of the locking means for allowing to initially release the bottle neck 4. It indicates with an appearance that the stopper has been used and the bottle neck 4 has previously opened.

Figure 8:
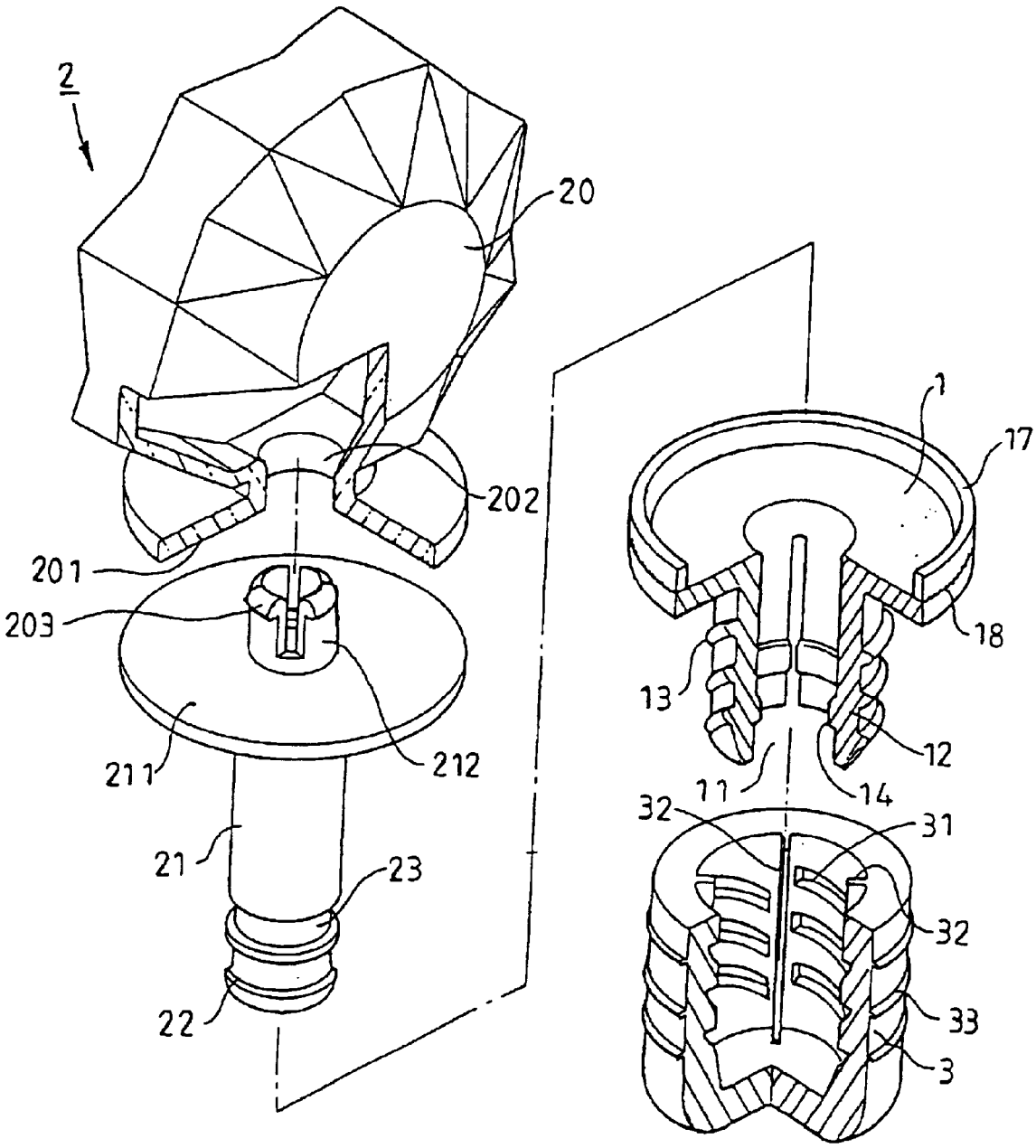
FIG. 8 is an exploded perspective view in partial cut-away illustrating a bottle stopper in accordance with a third embodiment of the present invention.

FIG. 8 illustrates the bottle stopper of the third embodiment of the present invention mainly comprising a body 1, a plug 2 and a jacket 3. Referring to FIG. 8, reference numerals of the third embodiment has applied the identical numerals of the first embodiment. The body 1, the plug 2 and the jacket 3 of the third embodiment have the similar configuration and same functions as the first embodiment and the detailed descriptions are omitted. The body 1 further provides an annular flange 17 with a tear line 18 connecting to the radial edge of its top. The plug 2 is essentially consisted of a head 20 and a leg 21. The head 20 is made of glass and has a flare 201 and a blown hole (not labeled). The initial end of the leg 21 has a flange 211 and a fastener 212 engaging with the blown hole of the head 20 to form a singular member. A distal end of the fastener 212 further provides a hook 203 firmly engaging with the edge of the blown hole.

Figure 9:
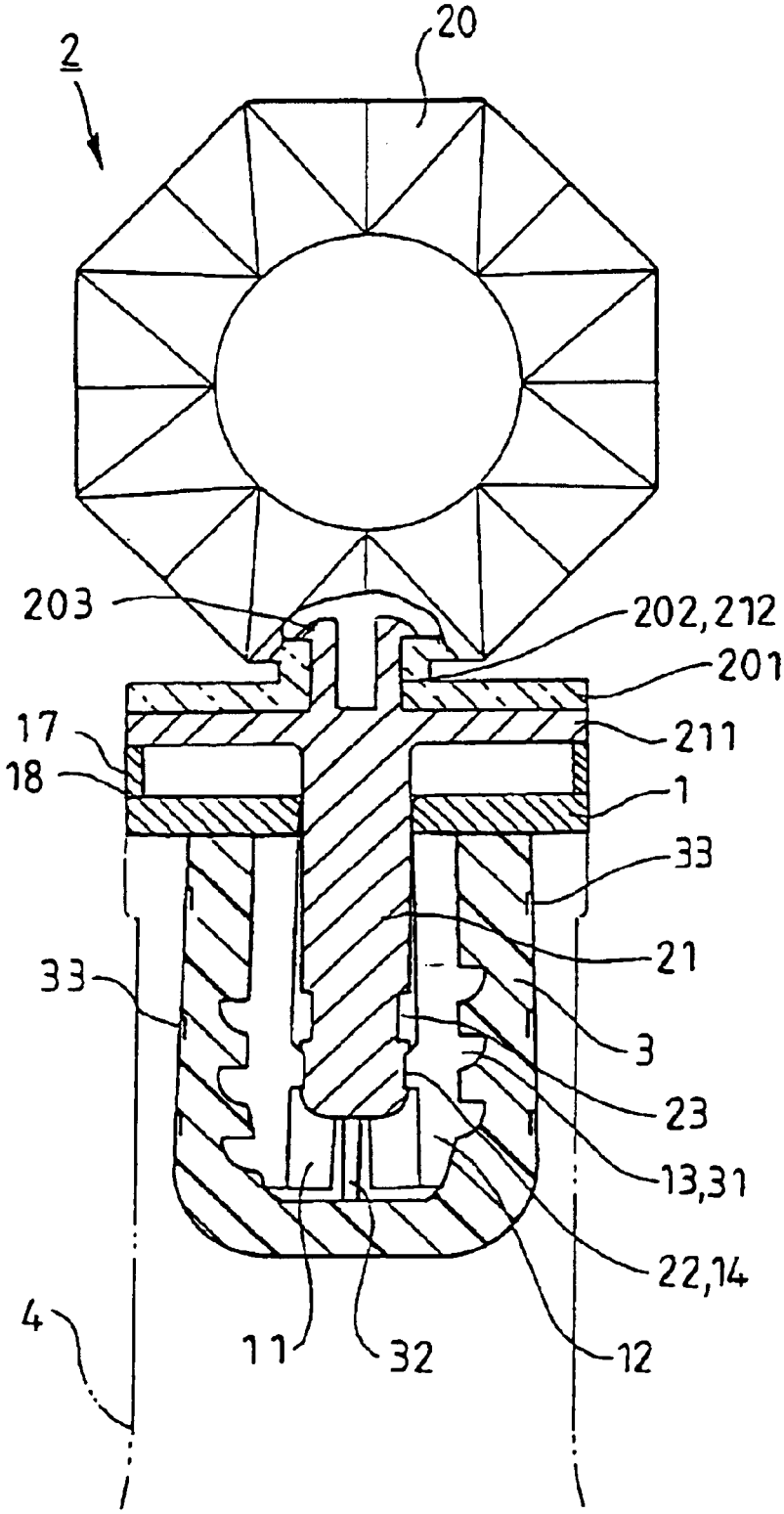
FIG. 9 is a vertical partially sectional view illustrating the bottle stopper in accordance with the third embodiment of the present invention in closing bottle process.

FIG. 9 illustrates the bottle stopper in accordance with the third embodiment of the present invention in closing bottle process. The technique of inserting the plug 2 to form a locking means has been described in detail in first embodiment for reference. Referring again to FIG. 9, when the first neck 22 engages with the protrusion 14 to form a locking means, the flange 17 obstructs the leg 21 of the plug 2 to advance downward relative to the body 1 that prevents the head 20 from being pressed to open the bottle neck 4 by accident. And it also has an appearance and a function of indicating whether the bottle neck has previously opened or the stopper has been used.

Figure 10:
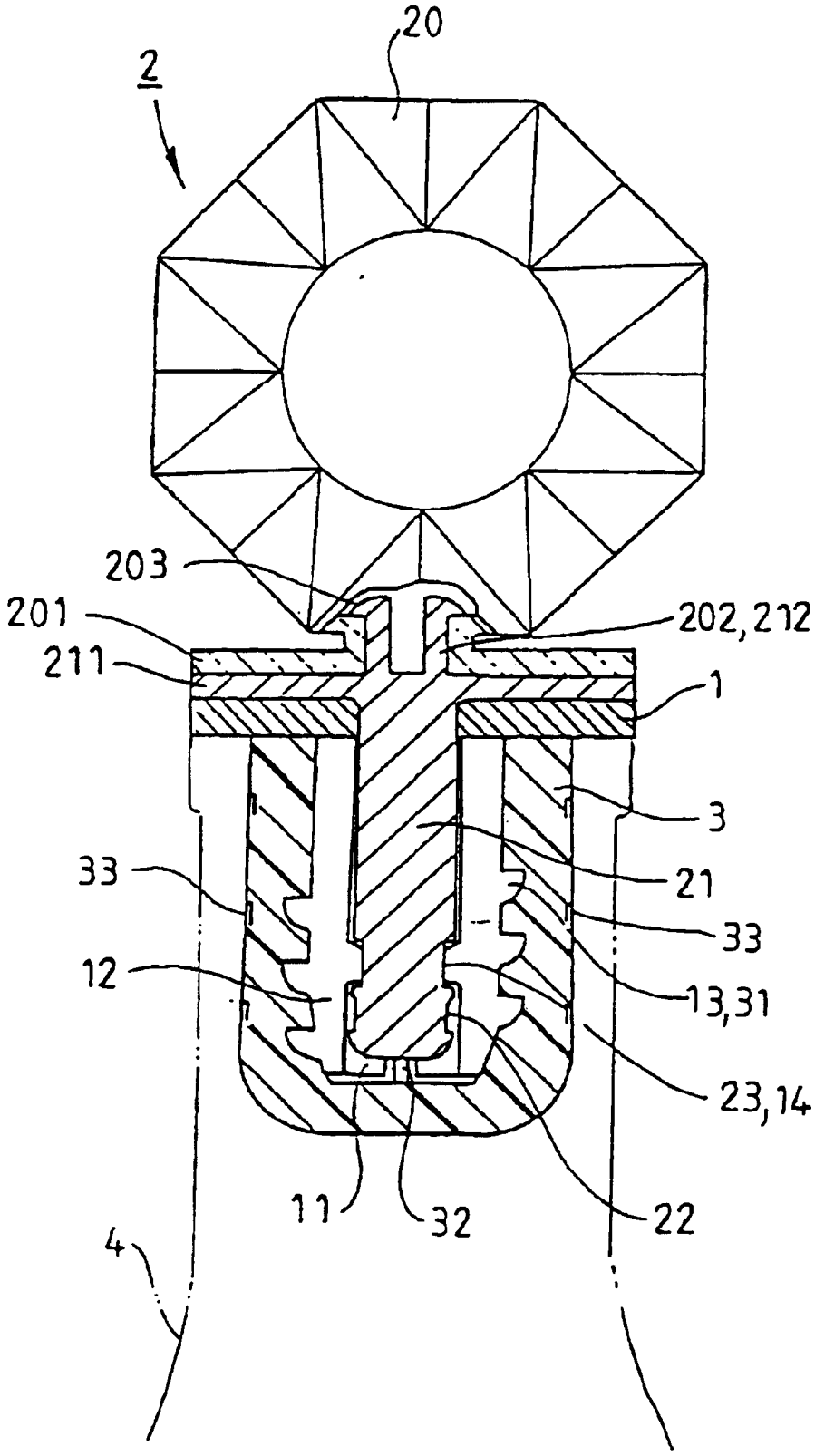
FIG. 10 is a vertical partially sectional view illustrating the bottle stopper in accordance with the third embodiment of the present invention in a step for releasing and resealing bottle neck.

FIG. 10 illustrates the bottle stopper in accordance with the third embodiment of the present invention in a step for releasing and resealing bottle neck. Referring again to FIG. 10, the flange 17 has been torn off along the tear line 18 and the plug 2 is pressed downward to form a resealing means, when the second neck 23 is engaged with the protrusion 14. The releasing means provides a slight expansion which diameter is relatively smaller than that of the locking means for allowing to initially release the bottle neck 4. The plug 2 with a tore appearance indicates that the stopper has been used and the bottle neck 4 has previously opened.

Figure 11:
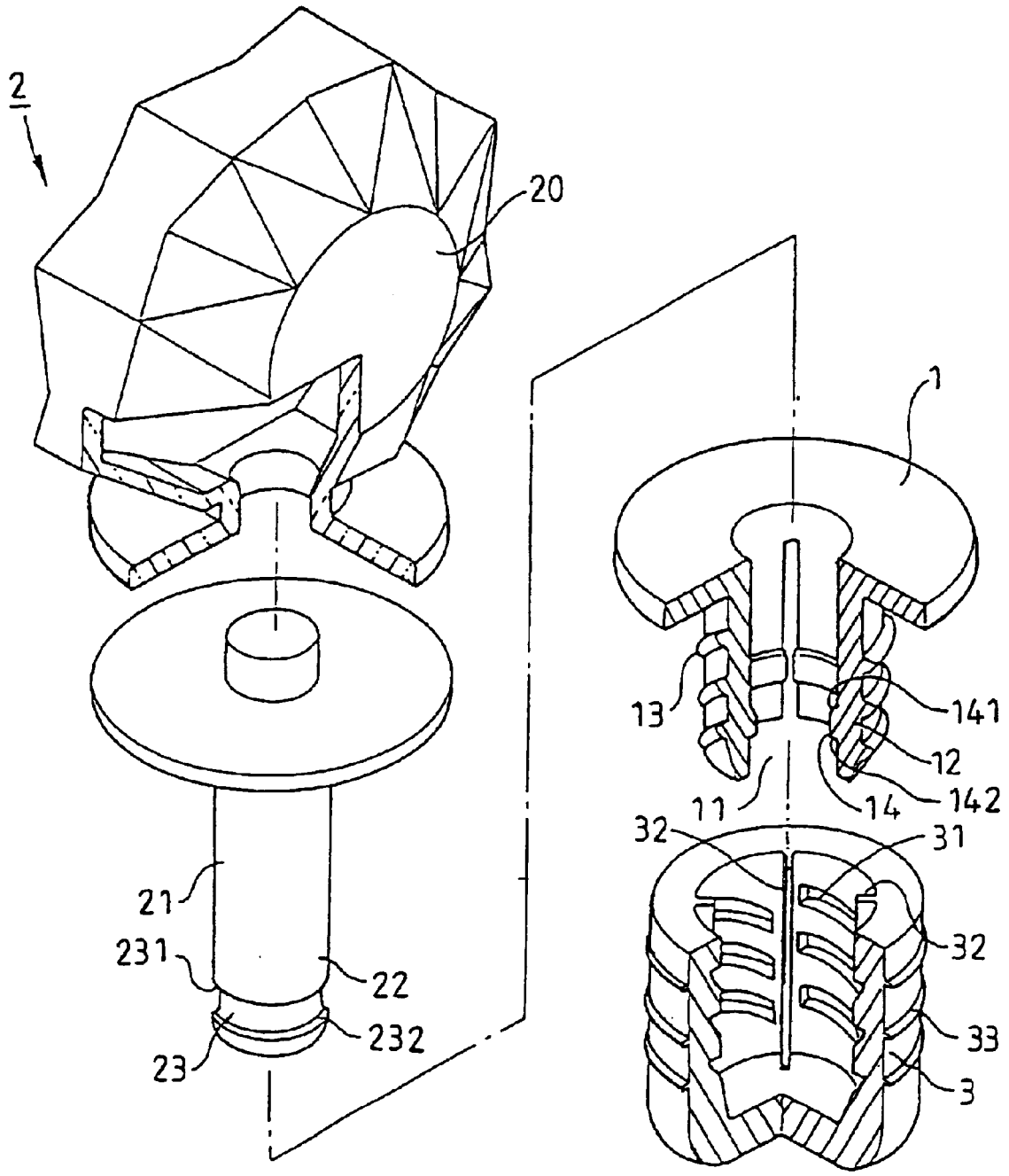
FIG. 11 is an exploded perspective view in partial cutaway illustrating a bottle stopper in accordance with a fourth embodiment of the present invention.

FIG. 11 illustrates the bottle stopper of the fourth embodiment of the present invention mainly comprising a body 1, a plug 2 and a jacket 3. Referring to FIG. 11, reference numerals of the fourth embodiment has applied the identical numerals of the first embodiment. The body 1, the plug 2 and the jacket 3 of the similar embodiment have the similar configuration and same functions as the first embodiment and the detailed descriptions are omitted. The plug 2 is essentially consisted of a head 20 and a leg 21. The head 20 is made of glass and has a flare and a blown hole (not labeled). The leg 21 has a protrusion on an upper side of its top engaging with the blown hole of the head 20 to form a singular member. The leg 21 provides a neck 23 with a relatively smaller diameter abutting at 22 on its cylindrical surface. The protrusion 14 of the body 1 is engaged with the neck 23 of the leg 21 to form a resealing means, when the resealing means provides a slightly greater expansion on the cylindrically outer surface of the bottle stopper. By contrast, the protrusion 14 is engaged with the leg 21 at 22 to form a resealing means, when the resealing means provides a slightly greater expansion on the cylindrically outer surface of the bottle stopper.

Figure 12:
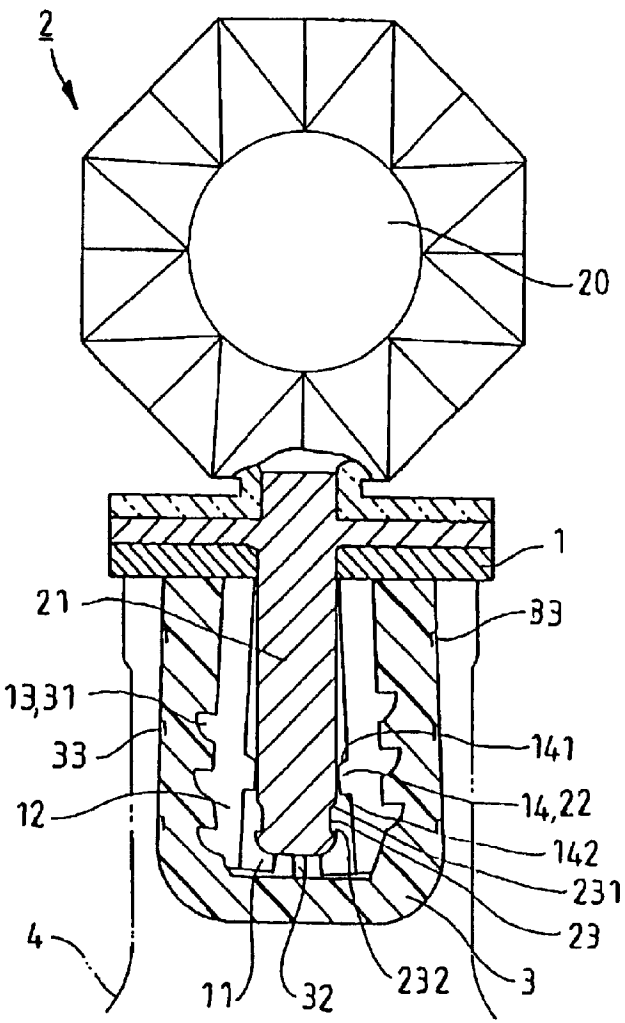
FIG. 12 is a vertical partially sectional view illustrating the bottle stopper in accordance with the fourth embodiment of the present invention in closing bottle process.

FIG. 12 illustrates the bottle stopper in accordance with the fourth embodiment of the present invention in closing bottle process. Referring again to FIG. 12, when the cylindrical surface of the leg 21 at 22 engages with the protrusion 14, the bottle stopper provides the locking means with the maximum expansion to lock the bottle neck 4. The top of the leg 21 is adhered to the top of the body 1 by adhesive agent and it has an appearance and a function of indicating whether the bottle neck has previously opened or the stopper has been used.

Figure 13:
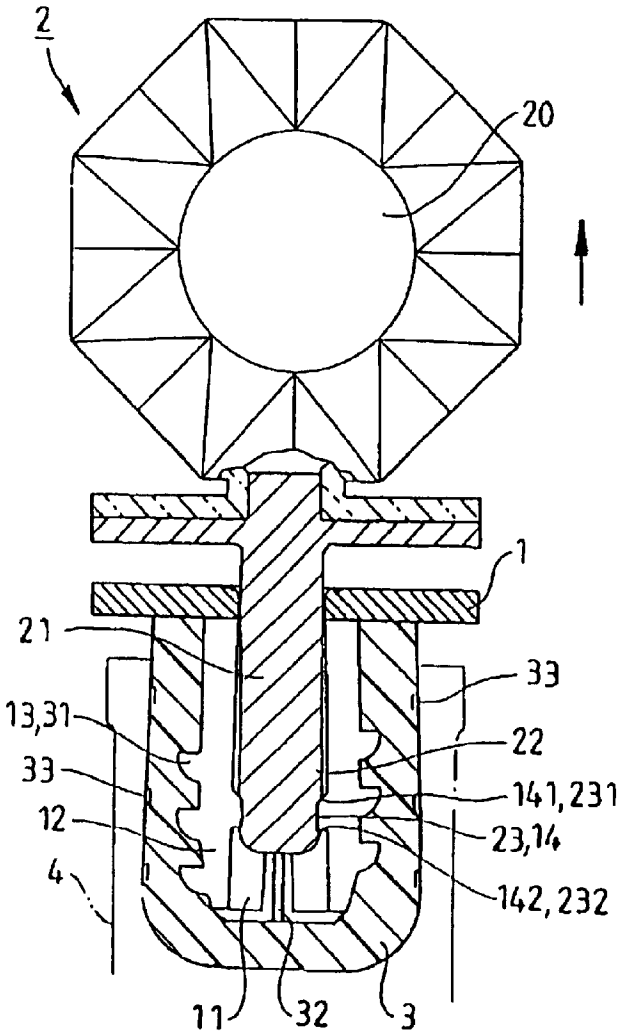
FIG. 13 is a vertical partially sectional view illustrating the bottle stopper in accordance with the fourth embodiment of the present invention in a step for releasing and resealing bottle neck.

FIG. 13 illustrates the bottle stopper in accordance with the fourth embodiment of the present invention in a step for releasing and resealing bottle neck. Referring again to FIG. 13, the plug 2 is pulled upward with respect to the body 1 by pulling force to form a resealing means, when the neck 23 is engaged with the protrusion 14. The releasing means provides a slight expansion which diameter is relatively smaller than that of the locking means for allowing to initially release the bottle neck 4. The plug 2 with a separated top appearance indicates that the stopper has been used and the bottle neck 4 has previously opened. The bottle plug of the fourth embodiment can be reused for securely resealing the bottle neck 4 after initially released, as shown in FIG. 12.

Figure 14:
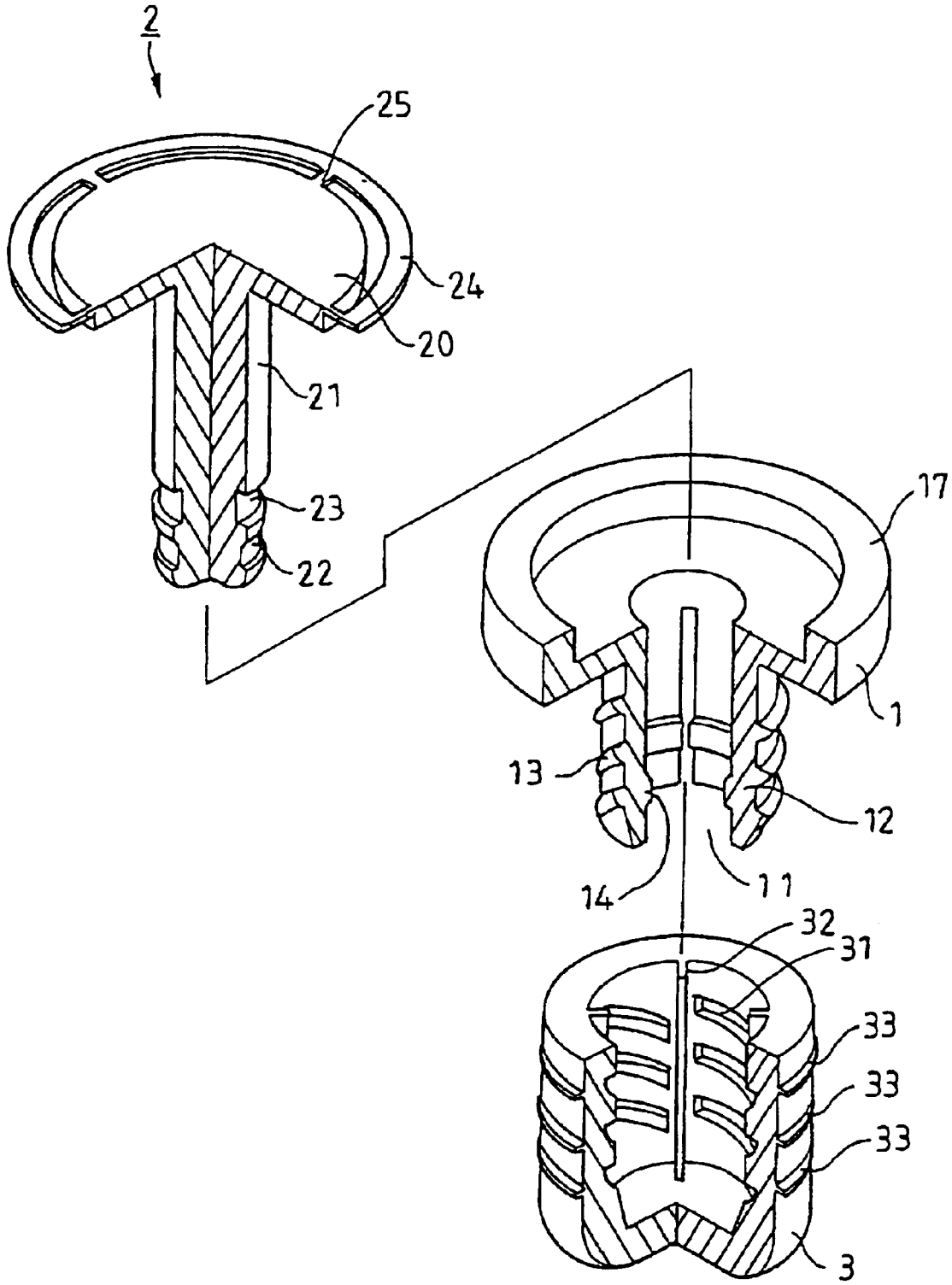
FIG. 14 is an exploded perspective view in partial cutaway illustrating a bottle stopper in accordance with a fifth embodiment of the present invention.

FIG. 14 illustrates the bottle stopper of the fifth embodiment of the present invention mainly comprising a body 1, a plug 2 and a jacket 3. Referring to FIG. 14, reference numerals of the fourth embodiment has applied the identical numerals of the first embodiment. The body 1 and the jacket 3 of the similar embodiment have the similar configuration and same functions as the first embodiment and the detailed descriptions are omitted. The body 1 further provides an annular flange 17 projected upward at the radial edge of its top to form an appropriate recession. The plug 2 is essentially consisted of a leg 21 and a top 20 with the same configuration as the recession of the body 1 for receiving. A radial edge of the top 20 radially extends a plurality of ribs 25 supporting an annular respectively thin edge 24 which has the same radius as that of the flange 17. Accordingly, the thin edge 24 can be appropriately forced to separate from the top 20 on the body 1 for initially releasing the bottle stopper.

Figure 15:
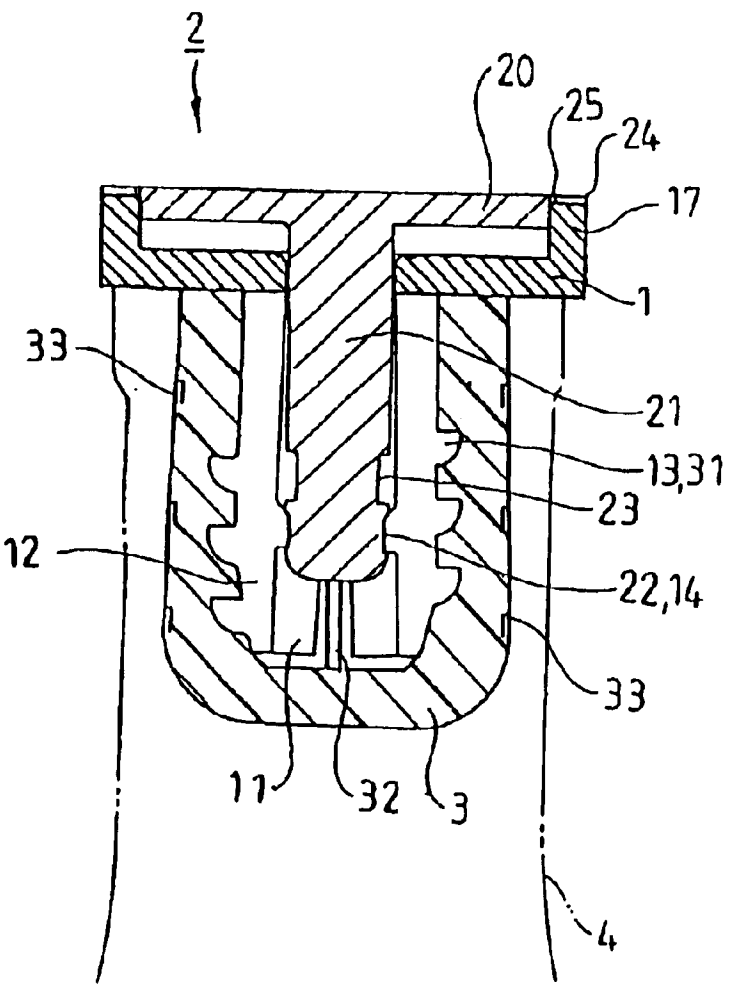
FIG. 15 is a vertical partially sectional view illustrating the bottle stopper in accordance with the fifth embodiment of the present invention in closing bottle process.

FIG. 15 illustrates the bottle stopper in accordance with the fifth embodiment of the present invention in closing bottle process. The technique of inserting the plug 2 to form a locking means has been described in detail in first embodiment for reference. Referring again to FIG. 15, when the first neck 22 engages with the protrusion 14 to form a locking means, the thin edge 24 rests on a rim of the flange 17. The thin edge 24 obstructs the leg 21 to advance downward relative to the body 1 that prevents the top 20 of the plug 2 from being pressed to open the bottle neck 4 by accident. And it also has an appearance and a function of indicating whether the bottle neck has previously opened or the stopper has been used.

Figure 16:
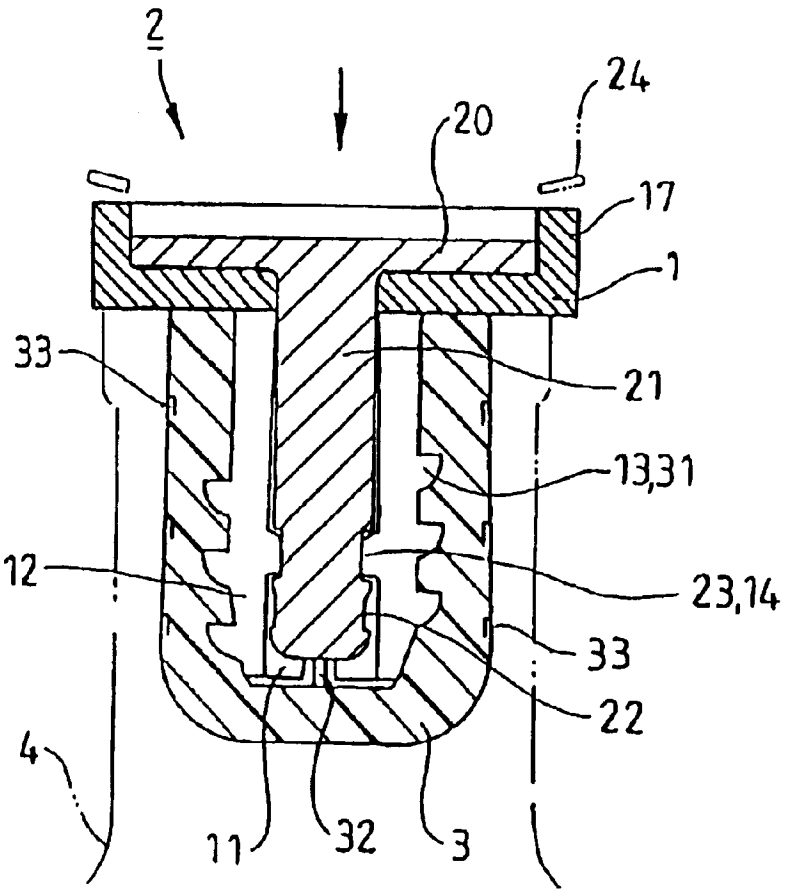
FIG. 16 is a vertical partially sectional view illustrating the bottle stopper in accordance with the fifth embodiment of the present invention in a step for releasing and resealing bottle neck.

FIG. 16 illustrates the bottle stopper in accordance with the fifth embodiment of the present invention in a step for releasing and resealing bottle neck. Referring again to FIG. 16, the plug 2 is pressed downward and the thin edge 24 is forced to separate from the top 20, when the second neck 23 is engaged with the protrusion 14 to form a resealing means. The releasing means provides a slight expansion which diameter is relatively smaller than that of the locking means for allowing to initially release the bottle neck 4. The top 20 without the thin edge 24 appearance indicates that the stopper has been used and the bottle neck 4 has previously opened.

Figure 17:
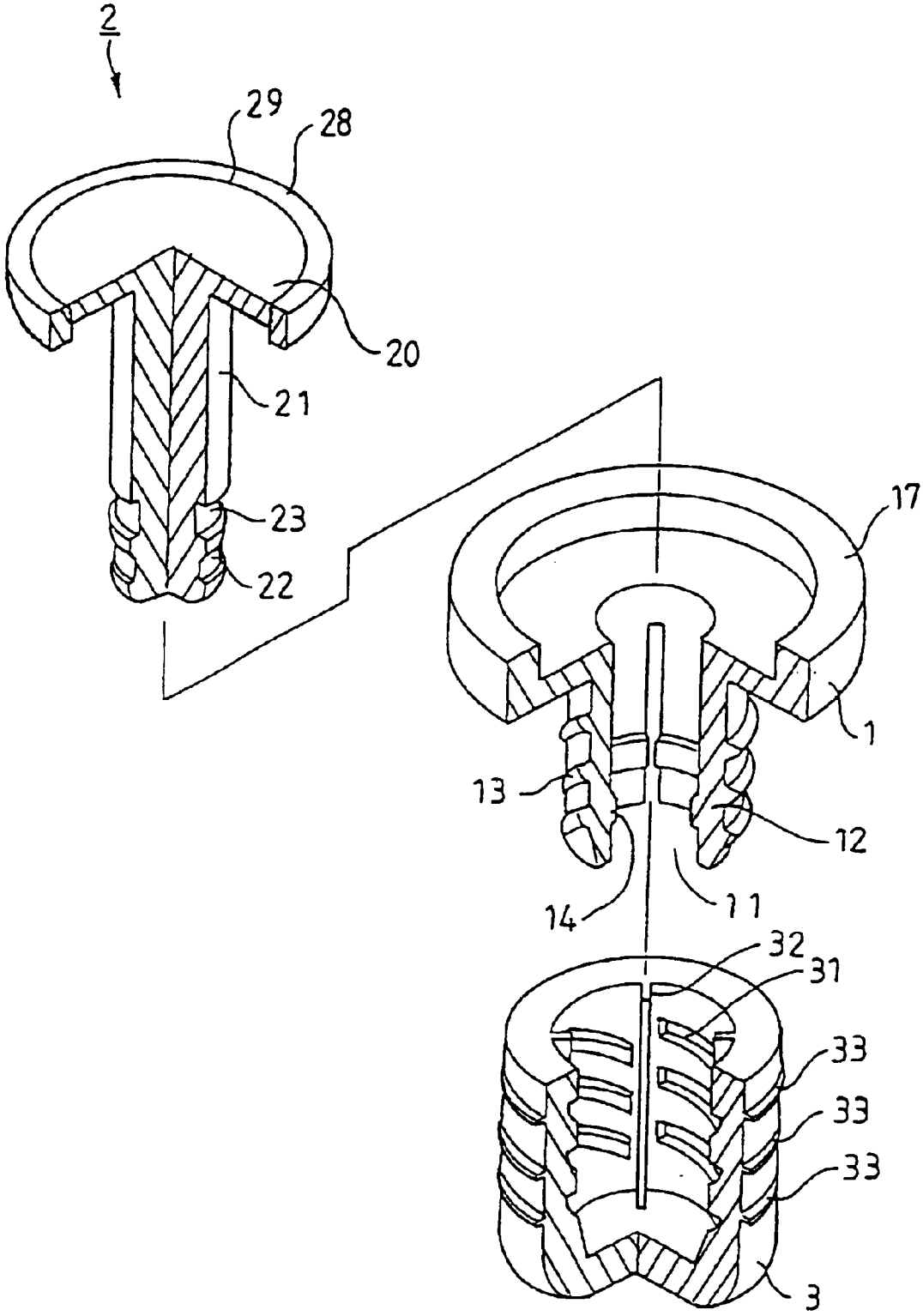
FIG. 17 is an exploded perspective view in partial cutaway illustrating a bottle stopper in accordance with a sixth embodiment of the present invention.

FIG. 17 illustrates the bottle stopper of the sixth embodiment of the present invention mainly comprising a body 1, a plug 2 and a jacket 3. Referring to FIG. 17, reference numerals of the third embodiment has applied the identical numerals of the first embodiment. The body 1, the plug 2 and the jacket 3 of the sixth embodiment have the similar configuration and same functions as the first embodiment and the detailed descriptions are omitted. The body 1 further provides an annular flange 17 projected upward at a radial edge of its top to form a recession preferably with uniform maximum radius and uniform depth. The plug 2 is essentially consisted of a top 20 and a leg 21. A tear line 29 connects a flange 28 with a radial edge of the top 20. The maximum radius of the flange 28 is preferred consistence with that of the recession for receiving.

Figure 18:
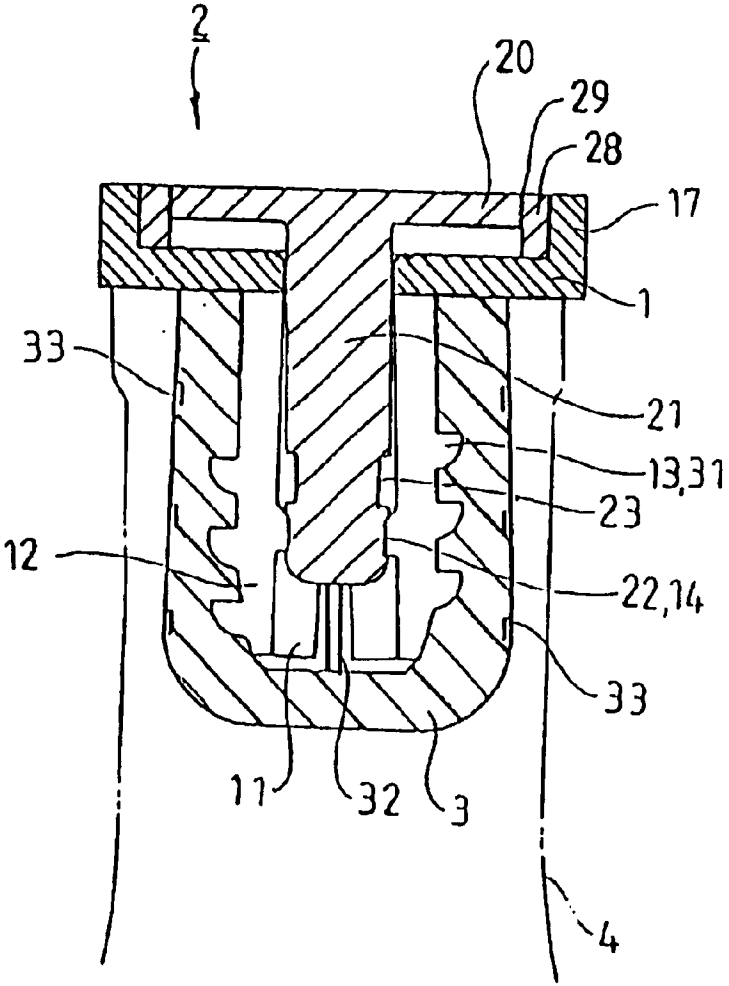
FIG. 18 is a vertical partially sectional view illustrating the bottle stopper in accordance with the sixth embodiment of the present invention in closing bottle process.

FIG. 18 illustrates the bottle stopper in accordance with the sixth embodiment of the present invention in closing bottle process. The technique of inserting the plug 2 to form a locking means has been described in detail in first embodiment for reference. Referring again to FIG. 18, when the first neck 22 engages with the protrusion 14 to form a locking means, the flange 28 obstructs the leg 21 to advance downward relative to the body 1 that prevents the plug 2 from being pressed to open the bottle neck 4 by accident. And it also has an appearance and a function of indicating whether the bottle neck has previously opened or the stopper has been used.

Figure 19:
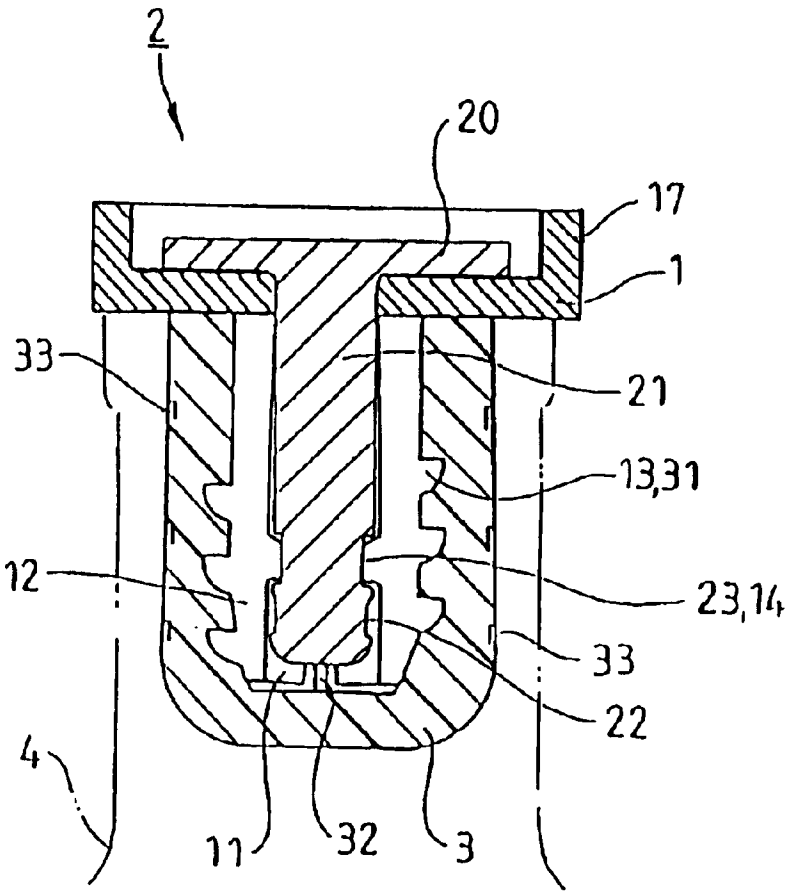
FIG. 19 is a vertical partially sectional view illustrating the bottle stopper in accordance with the sixth embodiment of the present invention in a step for releasing and resealing bottle neck.

FIG. 19 illustrates the bottle stopper in accordance with the sixth embodiment of the present invention in a step for releasing and resealing bottle neck. Referring again to FIG. 19, the flange 28 has been separated along the tear line 29 and the plug 2 is pressed downward to form a resealing means, when the second neck 23 is engaged with the protrusion 14. The releasing means provides a slight expansion which diameter is relatively smaller than that of the locking means for allowing to initially release the bottle neck 4. The plug 2 with a tore appearance indicates that the stopper has been used and the bottle neck 4 has previously opened.

Figure 20:
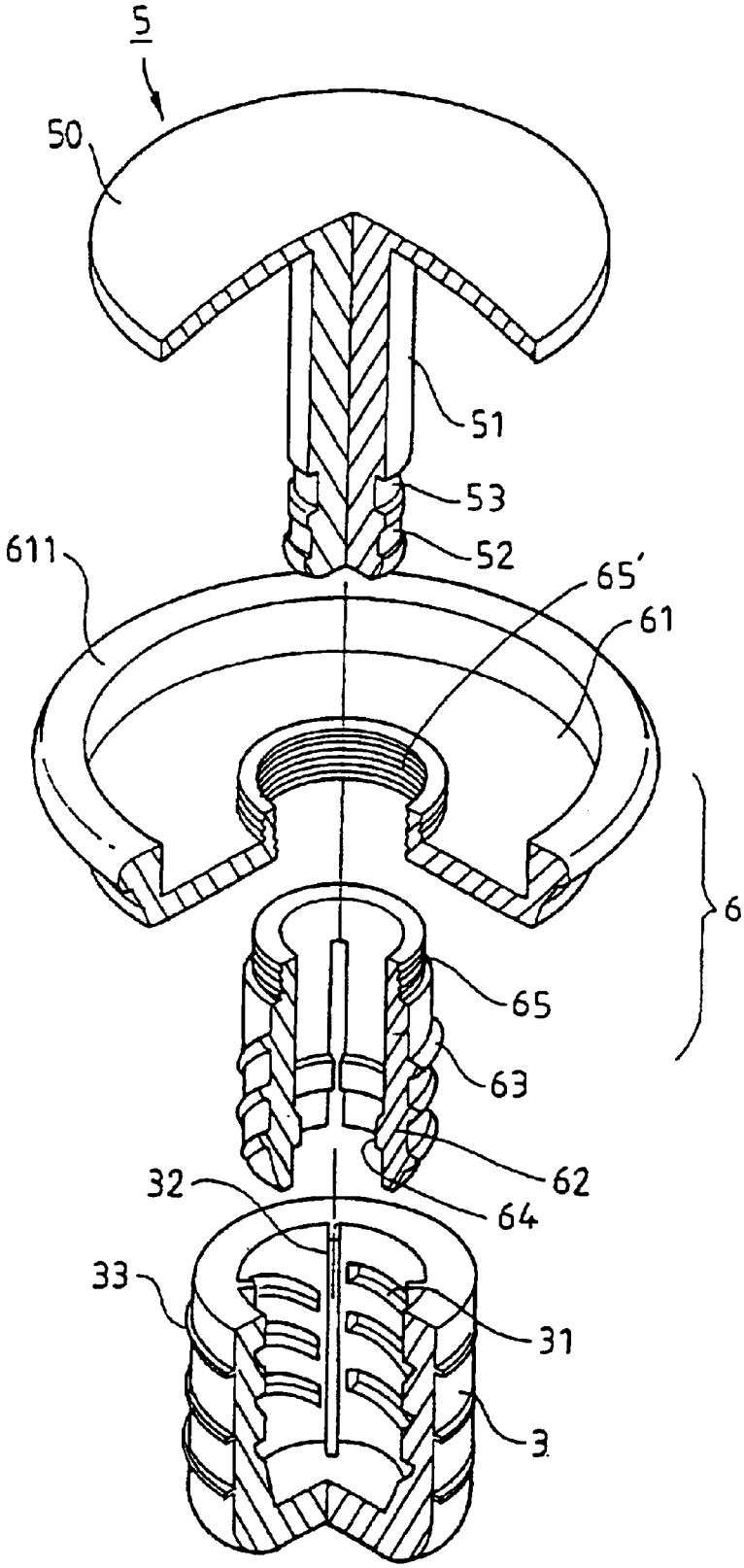
FIG. 20 is an exploded perspective view in partial cutaway illustrating a bottle stopper in accordance with a seventh embodiment of the present invention.

Referring to FIG. 20, a bottle stopper in accordance with a seventh embodiment of the present invention mainly includes a body generally designated as numeral 6, a plug as numeral 5 and a jacket as numeral 3.

Referring to FIG. 20, the jacket 3 of the seventh embodiment has the similar configuration and same functions as the first embodiment and the detailed description is omitted. The body 6 is essentially consisted of a top element 61 and an expansion element 62 combining as a one unit. The top element 61 is made of metal, glass, crystal or hardened solid material, which configuration has a flare 611 at its radial edge forming a recession with an uniform radius and an opening at its center. The expansion element 62 has a plurality of flexible walls 62 and inner circumference of which provides a slightly protrusion 64 projecting inwardly in a common plane perpendicular to the axis defined by the body 6. The outer circumference of each flexible wall 62 further provides a plurality of screwing ribs 63 projecting outwardly and encircling co-axially around the axis of the body 6. The element 61 has a thread 65 with the same diameter as a thread 65' of the element 62. The thread 65 is screwed with the thread 65' with respect to a common axis and adhesive is filled between them for firmly combining. The plug 5 is essentially consisted of a button 50 and a leg 51 formed as a single member. The button 50 has uniform radial edge preferred with the same radius as that of the recession so as to allow the vertical movement within it. The leg 51 provides a first neck 52 to form a locking means and a second neck 53 with a smaller diameter relative to the first neck 52 to form a resealing means.

Figure 21:
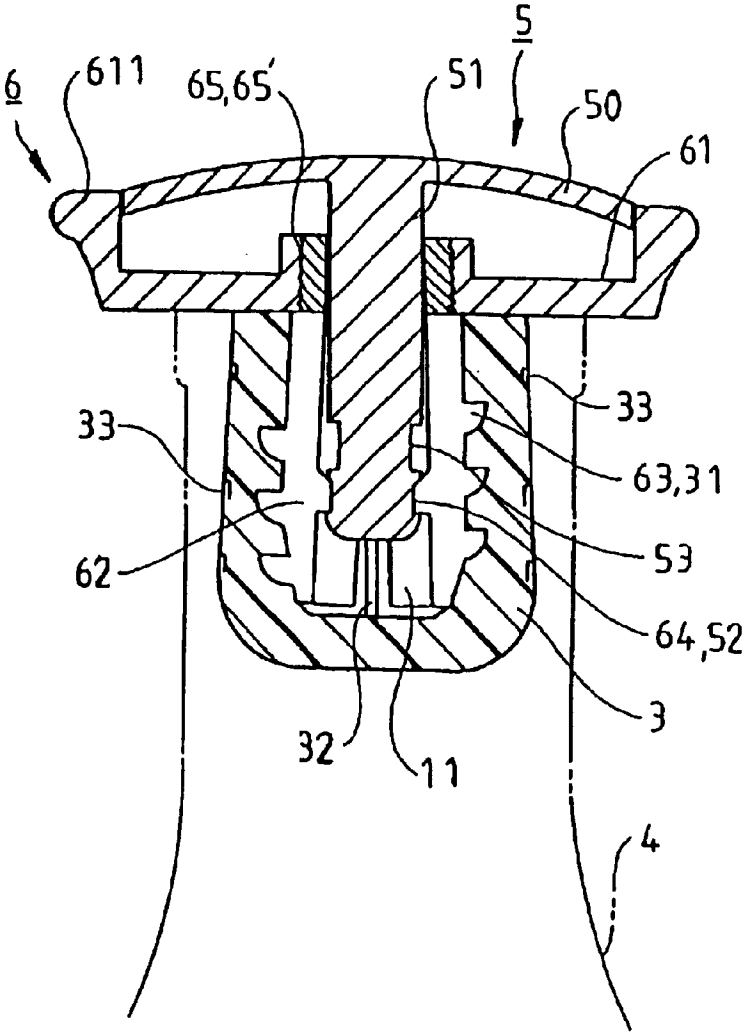
FIG. 21 is a vertical partially sectional view illustrating the bottle stopper in accordance with the seventh embodiment of the present invention in closing bottle process.

FIG. 21 illustrates the bottle stopper in accordance with the seventh embodiment of the present invention in closing bottle process. The technique of inserting the plug 5 to form a locking means has been described in detail in first embodiment for reference. Referring again to FIG. 21, when the first neck 52 engages with the protrusion 64 to form a locking means, a device (not shown) can obstruct the leg 51 to advance downward relative to the body 6 that prevents the plug 5 from being pressed to open the bottle neck 4 by accident. And it also has a button's appearance and a function of indicating whether the bottle neck has previously opened or the stopper has been used.

Figure 22:
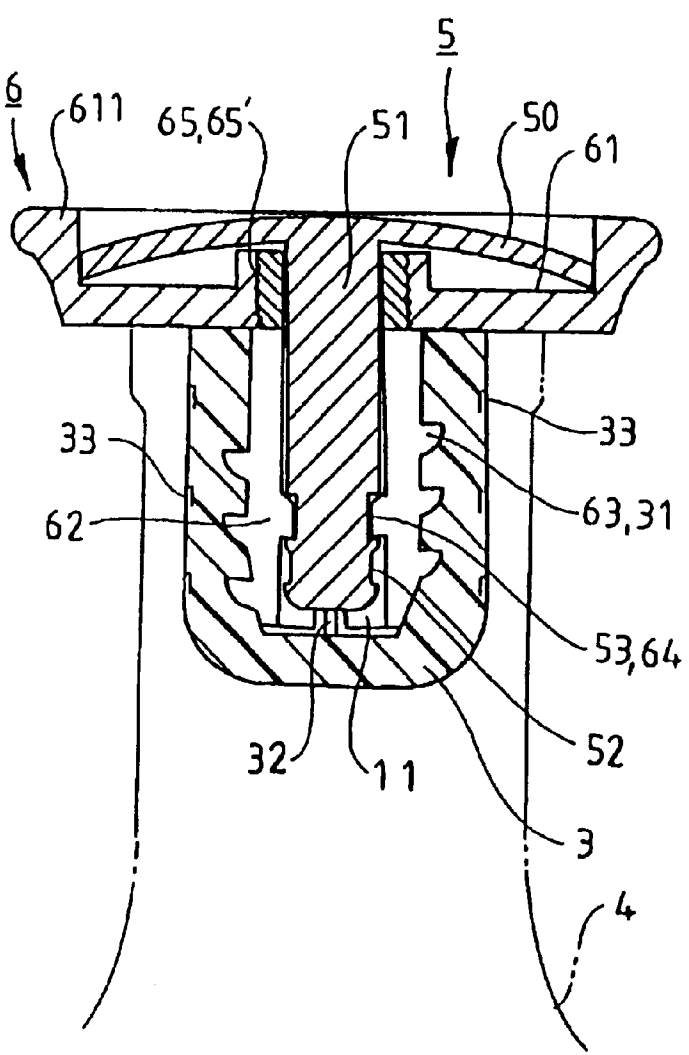
FIG. 22 is a vertical partially sectional view illustrating the bottle stopper in accordance with the seventh embodiment of the present invention in a step for releasing and resealing bottle neck.

FIG. 22 illustrates the bottle stopper in accordance with the seventh embodiment of the present invention in a step for releasing and resealing bottle neck. Referring again to FIG. 22, the device has been removed and the plug 5 is pressed downward to form a resealing means, when the second neck 53 is engaged with the protrusion 64. The releasing means provides a slight expansion which diameter is relatively smaller than that of the locking means for allowing to initially release the bottle neck 4. The button's appearance indicates that the stopper has been used and the bottle neck 4 has previously opened.

The bottle stopper of all embodiments in accordance with the present invention provides two expansion portions for forming a locking means and a resealing means in bottle neck, which effectiveness is particularly accomplishing the used bottle stopper after initially released. The bottle stopper of the second, third, fifth and sixth embodiment provides an obstructer preventing from an accidental press of a plug, which effectiveness is particularly accomplishing a high degree in quality assurance. And the bottle stopper of the first, second, third and fourth embodiment provides a head, which effectiveness is particularly accomplishing it made of various materials and devised various designs.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. A bottle plug comprising:

a body providing a plurality of flexible walls projected downward, an inner circumference of each flexible wall provides a slightly protrusion;

a plug having a leg providing a first neck to form a locking means and a second neck with a smaller diameter relative to the first neck to form a resealing means, an axis of the plug aligning to an axis of the body for co-axially receiving; and a jacket being adapted to receive the body and the plug respectively;

when the first neck engaged with the protrusion to form the locking means, it provides a maximum expansion to lock around a bottle neck;

and when the second neck engaged with the protrusion to form the resealing means, it provides a smaller expansion with respect to the maximum expansion for initially releasing and resealing the bottle neck.

2. The bottle stopper as defined in claim 1, further comprises an ornamental ring with an appropriate recess which provides a circular edge receiving the top of the body and a central opening for allowing the walls of the body extending through to combine with the jacket.

3. The bottle stopper as defined in claim 1, further comprises an obstructer obstructs an advance of the leg with respect to the body, which prevents from an accidental press of a plug.

4. The bottle stopper as defined in claim 3, wherein the obstructer is an annular flange with a tear line connecting to the radial edge of a top of the body.

5. The bottle stopper as defined in claim 3, wherein the obstructer is a flange with a tear line connecting to a radial edge of a top of the plug.

6. The bottle stopper as defined in claim 5, wherein the flange is thicker than the top, a bottom of the flange encounter with the body.

7. The bottle stopper as defined in claim 1, further comprises an ornamental ring and an obstructer, a rim of the ornamental encounters with the obstructer.

8. The bottle stopper as defined in claim 7, wherein the obstructer has a tear line and a base which is received in a recess of the ornamental ring to obstruct further advance of the leg with respect to the body, the obstructer can be torn off along the tear line.

9. The bottle stopper as defined in claim 1, wherein the protrusion of the each wall has an inclined surface with respect to an axis of the body.

10. The bottle stopper as defined in claim 1, wherein the first neck has a diameter slightly greater than that of the second neck.

11. The bottle stopper as defined in claim 1, wherein the first neck is an annular groove having an inclined surface with respect to an axis of the leg.

12. The bottle stopper as defined in claim 11, wherein the first neck further has a vertical surface with respect to an axis of the leg.

13. The bottle stopper as defined in claim 1, wherein the second neck is an annular groove defined by two vertical surfaces with respect to an axis of the leg.

14. The bottle stopper as defined in claim 1, wherein a top of the body has an opening with a polygon edge same as an initial end of the leg such that it can prevent from rotary movement.

15. The bottle stopper as defined in claim 1, wherein the plug has an annular wall projecting downward with respect to an axis of it and surrounding a radial edge of a top of the body.

16. The bottle stopper as defined in claim 1, further comprises a head combined with the leg as a single member.

17. The bottle stopper as defined in claim 16, wherein an initial end of the leg has a fastener engaging with a blown hole of the head to form a singular member.

18. The bottle stopper as defined in claim 17, wherein a distal end of the fastener further provides a hook firmly engaging with an edge of the blown hole.

19. The bottle stopper as defined in claim 16, wherein the head is combined with the leg by adhesive.

20. The bottle stopper as defined in claim 1, wherein an out circumference of the jacket provides a plurality of regularly spaced annular ribs.

21. A bottle stopper comprising:

a body providing a top element and a plurality of flexible walls projected downward, an inner circumference of each flexible wall provides a slightly protrusion;

a plug having a leg providing a first neck to form a locking means and a second neck with a smaller diameter relative to the first neck to form a resealing means, an axis of the plug aligning to an axis of the body for co-axially receiving; and a jacket being adapted to receive the body and the plug respectively;

when the first neck engaged with the protrusion to form the locking means, it provides a maximum expansion to lock around a bottle neck;

and when the second neck engaged with the protrusion to form the resealing means, it provides a smaller expansion with respect to the maximum expansion for initially releasing and resealing the bottle neck.

22. The bottle stopper as defined in claim 21, further comprises a button combined with the leg as a single member; the top element has a flare at its radial edge forming a recession; when the first neck is engaged with the protrusion, the button is received in the recession.

23. The bottle stopper as defined in claim 22, further comprises a device which can obstruct the leg to advance downward relative to the body and the device can be torn off along a tear line.

24. The bottle stopper as defined in claim 21, wherein an out circumference of the jacket provides a plurality of regularly spaced annular ribs.

* * * * *